US005624229A

United States Patent [19]

Kotzur et al.

[11] Patent Number: 5,624,229

[45] Date of Patent: Apr. 29, 1997

[54] SPIRAL HOUSING FOR A TURBOMACHINE

[75] Inventors: Joachim Kotzur, Oberhausen; Franz-Arno Richter, Dorsten; Lubomyr Turanskyj, Oberhausen, all of Germany

[73] Assignee: MAN Gutehoffnungshütte Aktiengesellschaft, Oberhausen, Germany

[21] Appl. No.: 436,355

[22] PCT Filed: Jul. 2, 1994

[86] PCT No.: PCT/EP94/02171

§ 371 Date: Jun. 12, 1995

§ 102(e) Date: Jun. 12, 1995

[87] PCT Pub. No.: WO95/08050

PCT Pub. Date: Mar. 23, 1995

[30] Foreign Application Priority Data

Sep. 17, 1993 [DE] Germany ..... 43 31 606.9

[51] Int. Cl.[6] ..... F04D 29/42

[52] U.S. Cl. ..... 415/204; 415/212.1

[58] Field of Search ..... 415/204, 205, 415/206, 212.1

[56] References Cited

U.S. PATENT DOCUMENTS

| | | | |
|---|---|---|---|
| 3,365,122 | 1/1968 | Hajec et al. | 415/204 |
| 3,380,711 | 4/1968 | Blattner et al. . | |
| 3,407,995 | 10/1968 | Kinsworthy | 415/204 |
| 5,069,599 | 12/1991 | Carretta | 415/204 |
| 5,474,422 | 12/1995 | Sullivan | 415/206 |

FOREIGN PATENT DOCUMENTS

| | | | |
|---|---|---|---|
| 95153 | 12/1923 | Germany | 415/204 |
| 1958629 | 5/1971 | Germany . | |
| 60-145497 | 7/1985 | Japan | 415/206 |
| 570995 | 11/1993 | Japan | 415/204 |
| 286975 | 11/1952 | Switzerland . | |
| 309294 | 11/1955 | Switzerland | 415/205 |
| 2251893 | 7/1992 | United Kingdom . | |

OTHER PUBLICATIONS

Kosmowski et al, "Turbomaschinen", Heidelberg, pp. 132–133 Dec. 1989.

*Primary Examiner*—James Larson
*Attorney, Agent, or Firm*—Max Fogiel

[57] ABSTRACT

A spiral housing with a spiral cross-section for a turbomachine, in which a disk diffuser with an upstream annular disk space is asymmetrical to the spiral cross-section. This spiral cross-section has a base circle of substantially constant diameter. The spiral cross-section also has a tongue region and a region adjacent to the tongue with circular spiral cross-sections extending to where an outside diameter of the spiral cross-section equals a specific diameter and the circular spiral cross-sections continue thereafter to increase in cross-section only axially.

5 Claims, 8 Drawing Sheets

$D_Z = 2r_Z$ $D_G = 2r_G$

SPIRAL HOUSING FOR A TURBOMACHINE

BACKGROUND OF THE INVENTION

The present invention concerns a spiral housing for a turbomachine. The upstream radial or semi-axial annular disk space of the disk diffuser in the event of a compressor, or the intake space of a turbine, is asymmetrical to the spiral cross-sections. The base-circle diameter $D_z$ is approximately constant.

An intake spiral for a radial turbine with an upstream separator is known from U.S. Pat. No. 3,380,711 (FIG. 3). The spiral housing exhibits only one spiral with a constant inner or base-circle diameter and with a constant outer radius in the event of an axially adapted flow cross-section. No decrease in the outer radius at the transition to a circular cross-section in the vicinity of the tongues is evident.

The spiral in the art known from pages 211 and 224 of Ventilatoren by Bruno Eck, Berlin etc., Springer, 5th edition, 1992 has a rectangular or circular cross-section. It merges upon arriving at the commencement of the tongue in the case of a compressor into an adjacent diffuser, usually a conical diffuser. Base-circle radius $r_z$ is usually approximately constant and equal to the outer radius $r_s$ of the annular disk space accommodated in the spiral. An ideal flow can simultaneously be maintained in the vicinity of the spiral tongue. The circular cross-section simultaneously results in relatively large radii $r_{A\ max}$, which contribute in particular to high manufacturing costs when the spiral is surrounded at high pressures by a cylindrical outer housing. An outer housing must, due to the $r_{A\ max}$, have a large inside diameter.

To decrease the $r_{A\ max}$ while maintaining a prescribed annular disk-space outer radius $r_s$, the base-circle radius $r_z$ is often hauled inward ($r_z<r_s$) in the prior art illustrated in FIG. 2 on page 213 of the Eck book while outer radius $r_A$ is left constant.

Such an approach, however, results in unfavorable flow conditions in the spiral, because the flow is decelerated in accordance with the law of angular momentum as the radius increases up to the end of the annular disk space in a compressor and must be re-accelerated in accordance with that law at the adjacent transition to smaller radii.

Since, however, the center of the circle constituted by the radius $r_k$ of curvature will no longer be on the axis A of the impeller and since the curvature of the inner contour is often inconstant, complex flow conditions contrary to the law of angular momentum will also occur in the vicinity of tongue Z. Given an axial spiral with a constant base-circle radius $r_z$ and a constant outer radius $r_A$ at the circumference in accordance with the art illustrated in FIG. 3 on page 214 of the Eck book, the law of angular momentum can be complied with along much of the spiral's centrical angle $\phi$ by adapting the axial length L of the spiral cross-section to the volumetric flow as it increases along the circumference. There will, however, still be complex conditions in the vicinity of the tongue.

SUMMARY OF THE INVENTION

The object of the present invention is accordingly a spiral housing that will ensure more efficient flow, that will be less expensive to manufacture, and that will lack the aforesaid drawbacks.

The base-circle diameter is accordingly approximately constant. The spiral cross-section of the region II–III adjacent to tongue region I–II along the circumference is approximately circular and, once it attains a prescribed outside diameter $D_A=D_G$, increases only axially.

The conditions for creating a channel vortex generated by asymmetric flow into the spiral will be ideal when the circular area with radius $R_G=(r_G-r_Z)/2$ is separated as the spiral continues into two semicircular areas $(R_G 2\cdot\pi)/2$ perpendicular to the axis with a rectangular area $2R_g\cdot L$ between them, whereby the rectangular area constantly increases axially in relation to L as centric angle $\phi$ increases while the semicircular areas $(R_G 2\cdot\pi)/2$ and the radial extent $2R_G$ remain constant.

The flow at the tongue of a spiral with a constant base-circle diameter and semicircular axial boundary in accordance with the present invention can be optimized. It will be of particular advantage for the commencement of the spiral tongue to extend co-axially along the top and bottom and continuously slope along the centric angle from the axial parallel direction into the direction of the radial tangent to the point of debouchment into the spiral connector.

Pressure will be ideally converted in the outlet duct adjacent to the spiral component if the outlet duct is a diffuser with a straight axis and merges continuously from the terminal cross-section of the spiral component into a circular cross-section at the terminal of the outlet duct.

Although the spiral housing specified herein is intended for a compressor, it can be employed with the flow reversed for a radial expander as well.

BRIEF DESCRIPTION OF THE DRAWINGS

Various embodiments of the present invention will now be specified with reference to the accompanying drawing, wherein.

DESCRIPTION OF THE PREFERRED EMBODIMENTS

The aforesaid figures will now be briefly described.

Figure 1:
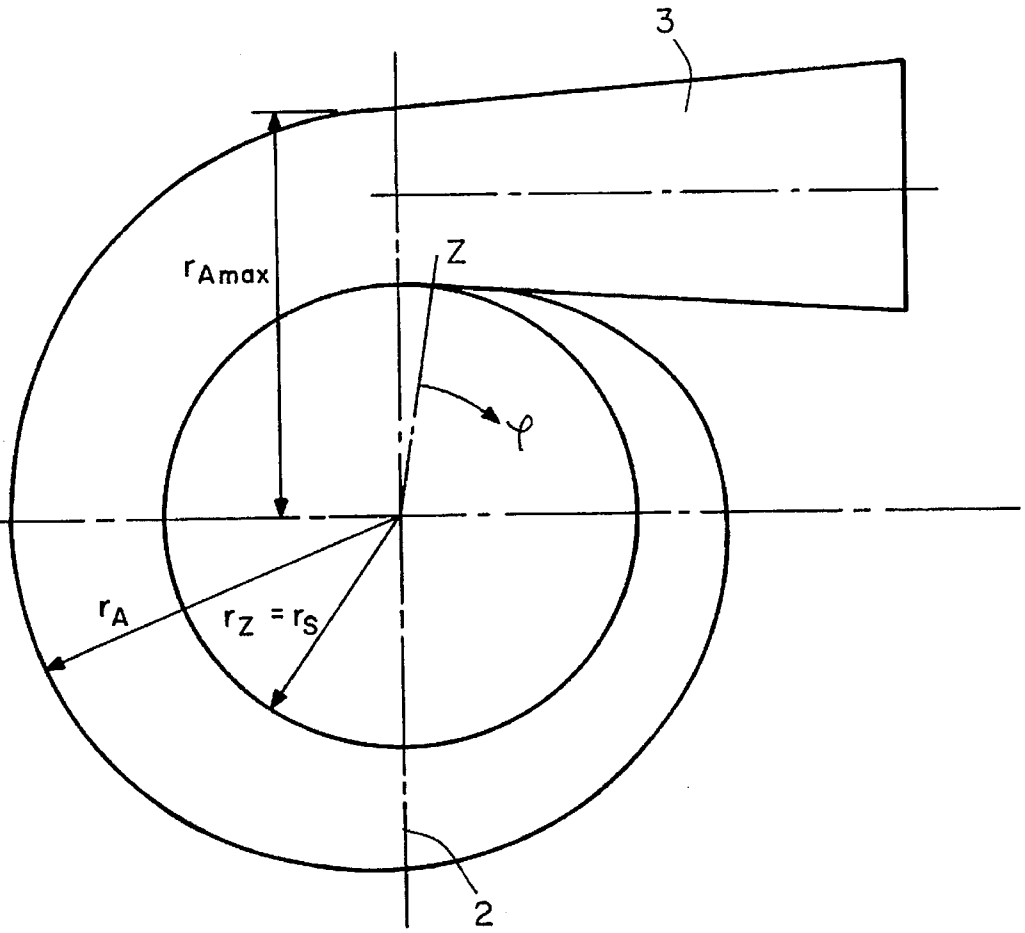
FIG. 1 PRIOR ART
FIG. 1 shows a section through a circular spiral with a constant base-circle diameter in accordance with the state of the art.
Figure 1A:
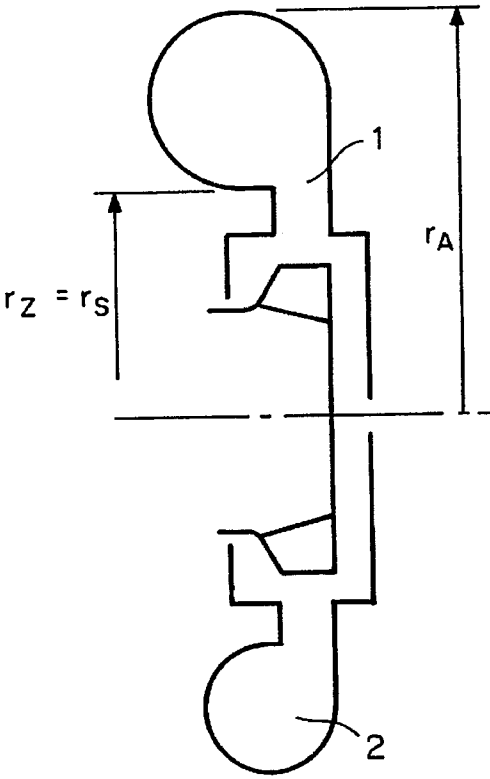
FIG. 1a PRIOR ART
FIG. 1*a* is an end view of FIG. 1.

FIG. 1 illustrates a spiral in accordance with the state of the art. It has a constant base-circle radius $r_z$. An upstream disk diffuser 1 is accommodated within a spiral 2 inwardly demarcated by base-circle radius $r_z$. The spiral cross-sections increase with the centric angle $\phi$ and hence outer radius $r_a$ to a value $r_{A\ max}$, upon which it is followed by an outlet duct formed as a conical diffuser 3.

Figure 2:
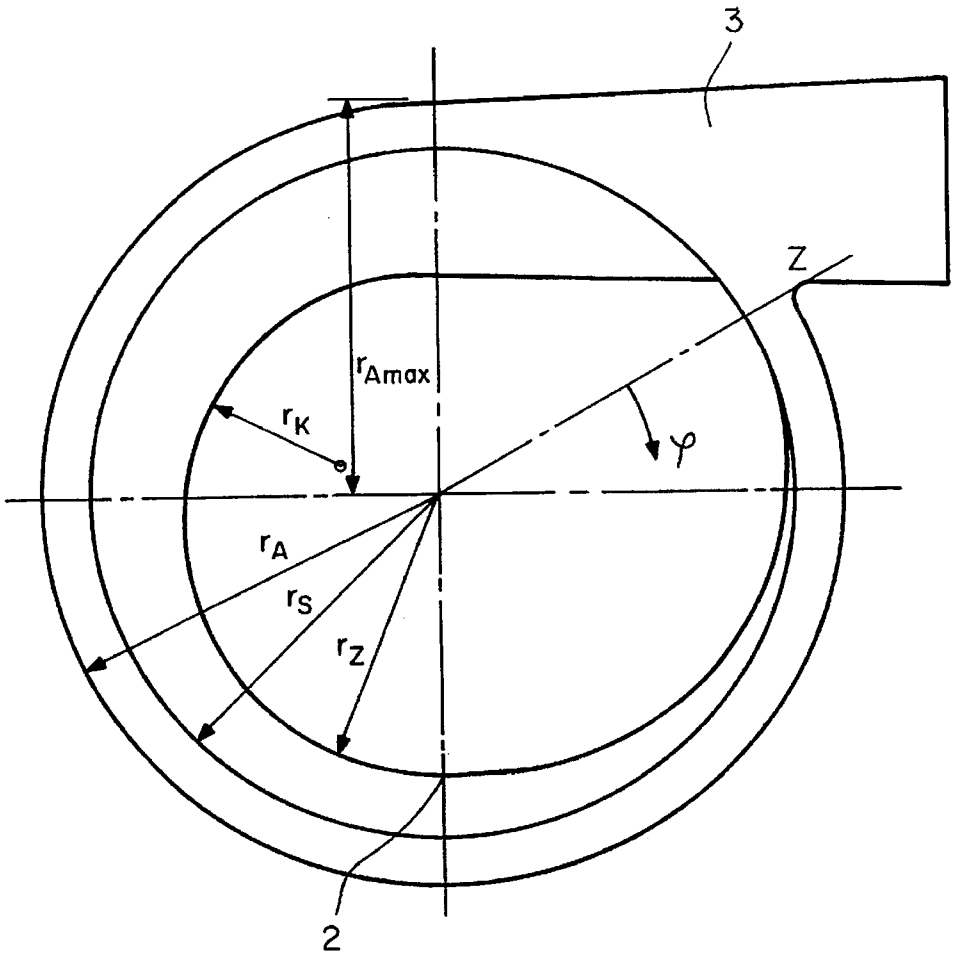
FIG. 2 PRIOR ART
FIG. 2 shows a section through a spiral with a constant outside diameter and inward-drawn spiral cross-sections in accordance with the state of the art.
Figure 2A:
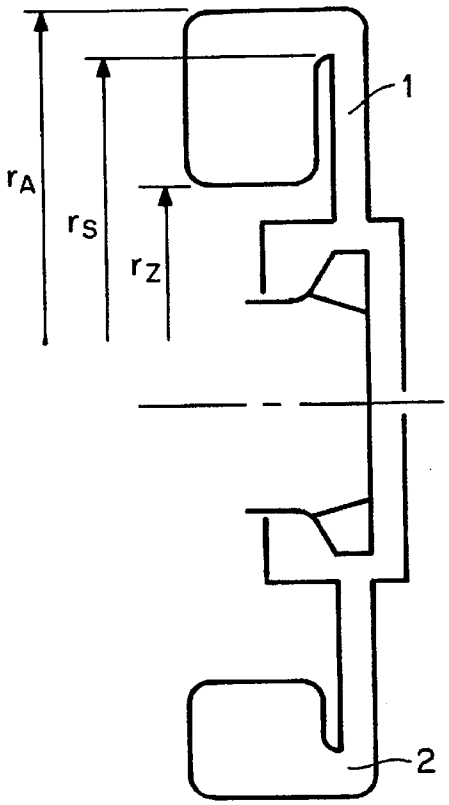
FIG. 2a PRIOR ART
FIG. 2*a* is an end view of FIG. 2.

FIG. 2 illustrates a spiral in accordance with the state of the art with a constant outer radius $r_A$ and a varying base-circle radius $r_z$. Upstream disk diffuser 1 has, except for the vicinity of tongue Z, a larger outer radius $r_s$ than the inner boundary $r_z$. The radius $r_k$ of curvature of the spiral's inner contour varies. Complex flow conditions occur in the vicinity of tongue Z at the transition between spiral 2 and outlet duct 3.

Figure 3:
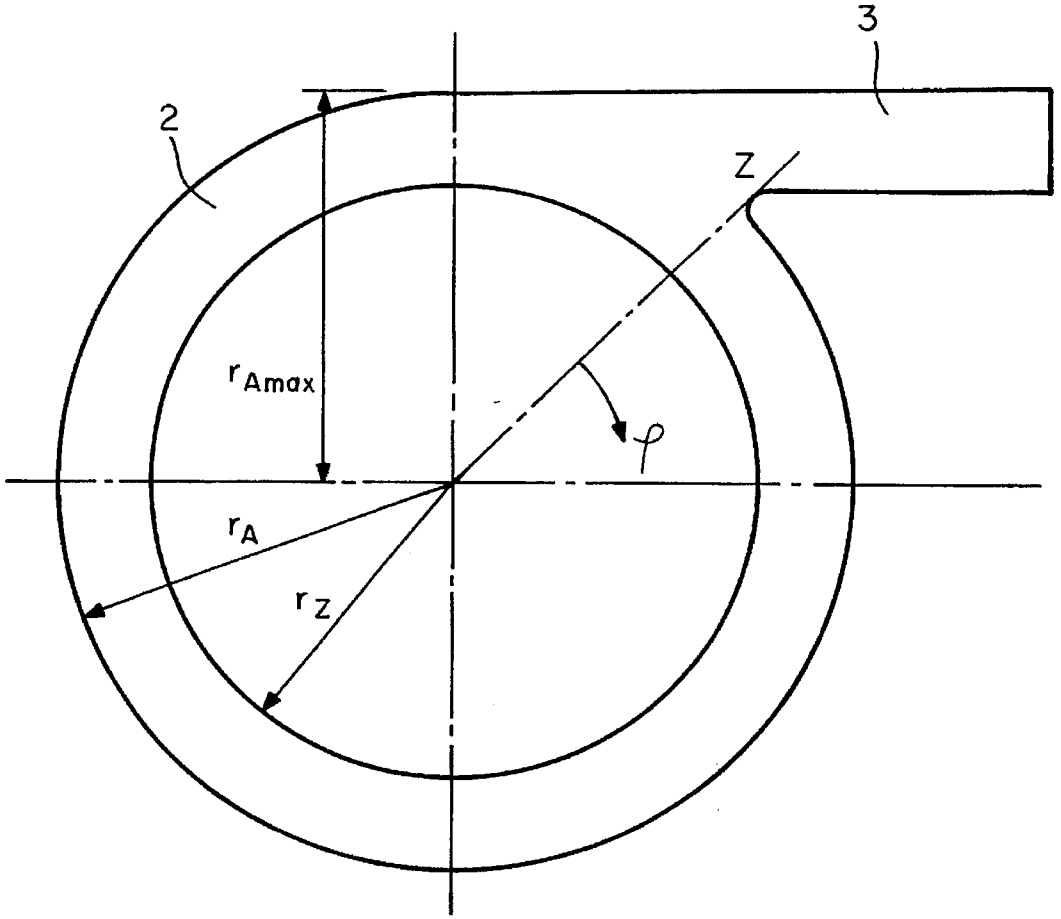
FIG. 3 PRIOR ART
FIG. 3 shows a section through a spiral with an outside diameter that is constant over its total circumference and with a base-circle diameter and axial extension of its spiral cross-section at state of the art.
Figure 3A:
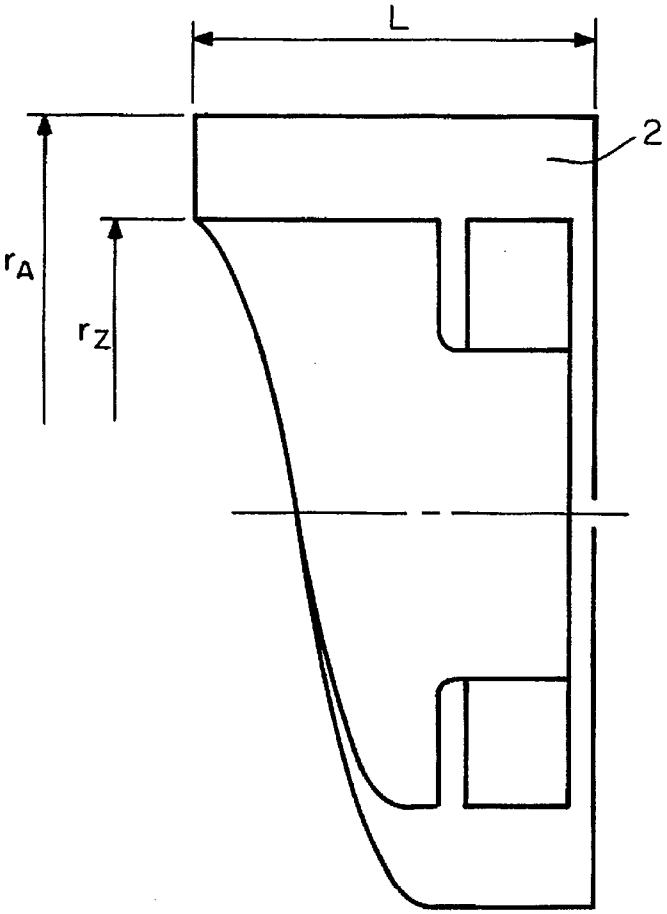
FIG. 3a PRIOR ART
FIG. 3*a* is an end view of FIG. 3.

FIG. 3 illustrates a spiral in accordance with the state of the art that develops axially and also has complex flow conditions in the vicinity of tongue Z.

Figure 4:
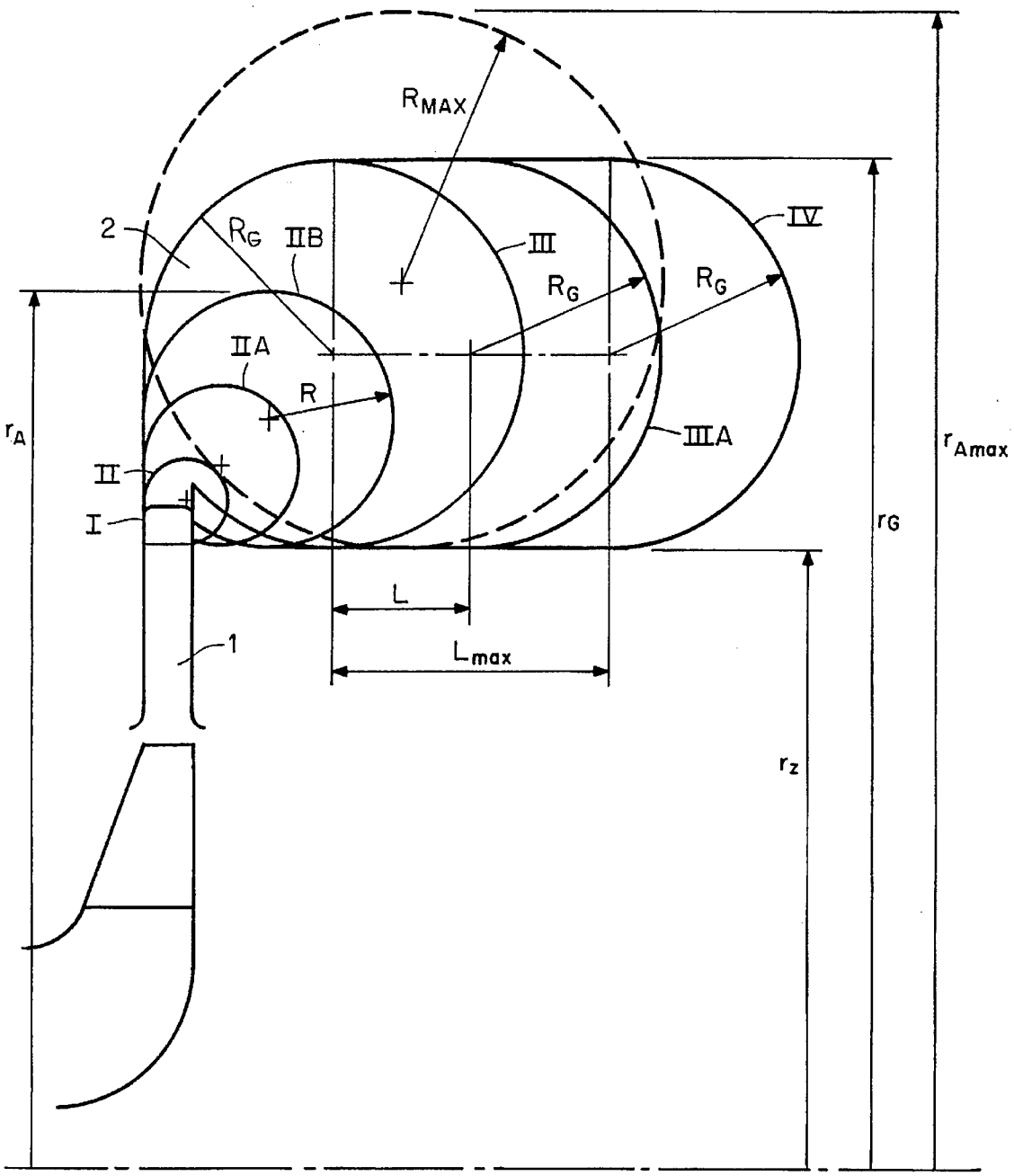
FIG. 4 a longitudinal section through a spiral with a spiral cross-section developed in accordance with the present invention.

FIG. 4 illustrates a spiral 2 in accordance with the present invention that develops adjacent to disk diffuser 1 in spiral cross-sections I through III as illustrated in FIG. 1. Such a spiral would extend as far as cross-section IV with $R_{max}$ as outer radius $r_A$. In the further development in accordance with the present invention in the form of two semicircles with radius $R_G$ as an axial boundary with an interposed rectangle of area 2 $R_G \cdot L$, outer radius $r_A$ does not increase beyond $r_G$.

Figure 5:
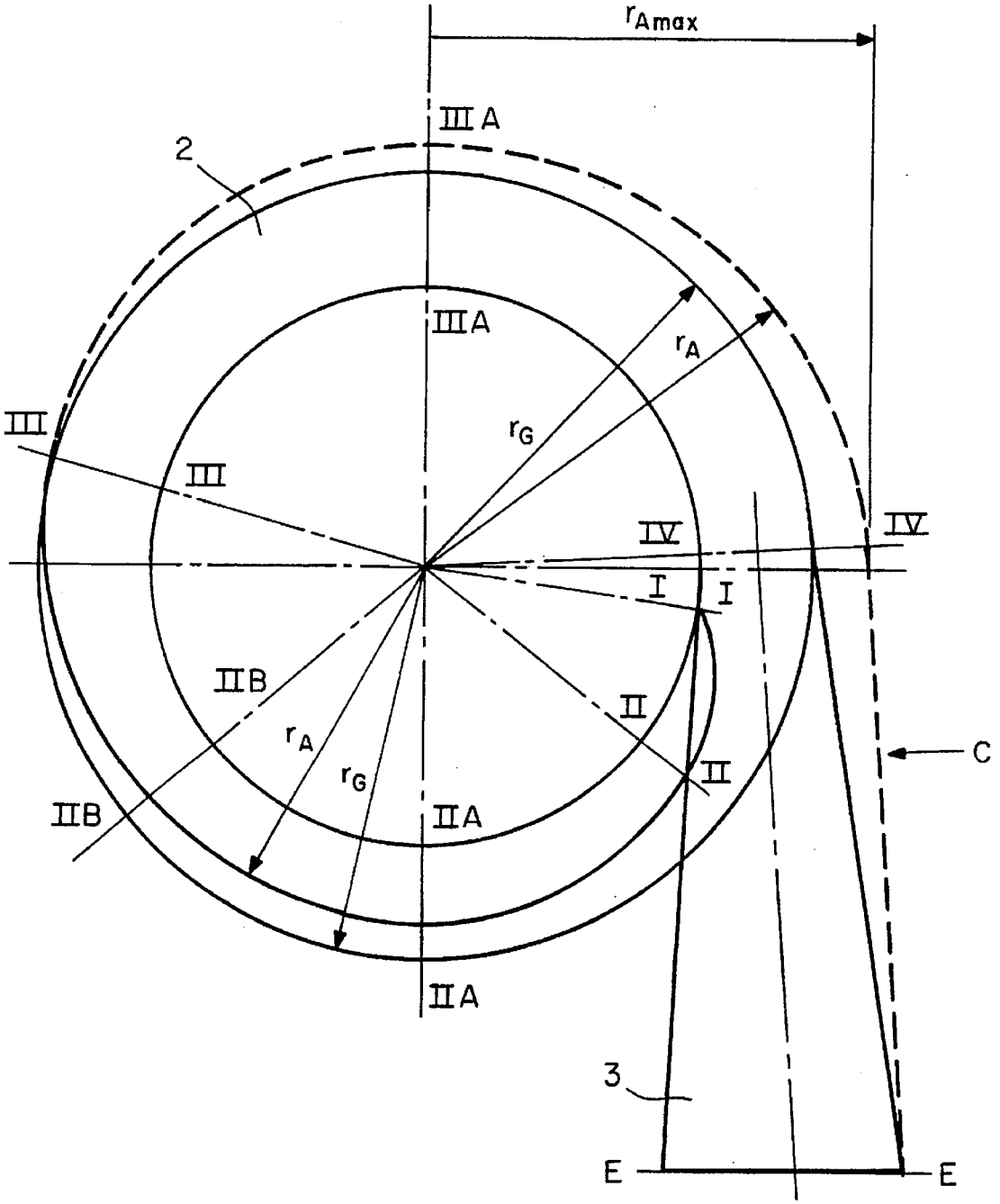
FIG. 5 a cross-section through a spiral in accordance with the present invention as illustrated in FIG. 4.

FIG. 5 illustrates a cross-section through the spiral in accordance with the present invention illustrated in FIG. 4, whereby the various circumferential zones I–II, II–III, and III–IV are evident. From point I—I to point III—III the outer radius $r_A$ of the spiral is smaller than the prescribed limiting radius $r_G$ of the casing. From point III—III to point IV—IV the outer radius $R_A$ of the spiral is $r_G$, which is smaller than the radius $r_A$ of a spiral with circular cross-section (dotted line), which would extend to a maximum outer radius $r_{A\ max}$, shown in FIG. 4.

Figure 6A:
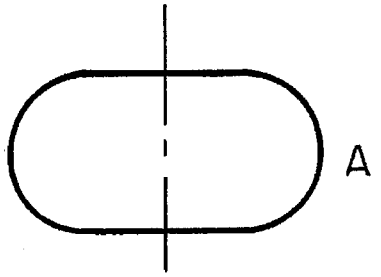
FIG. 6*a* is an initial cross-section of the diffuser of FIG. 6.
Figure 6:
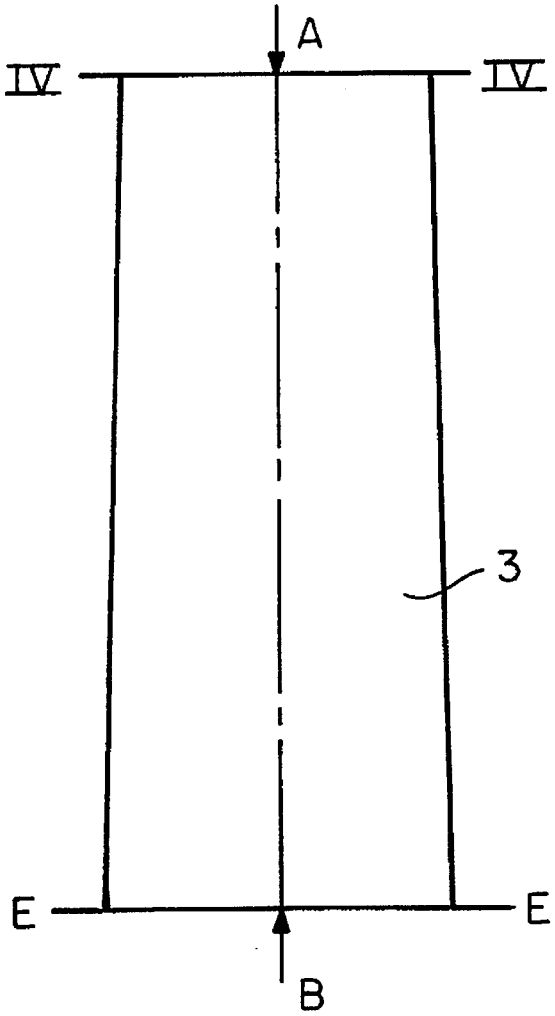
FIG. 6 a section through an outlet duct adjacent to the spiral.
Figure 6B:
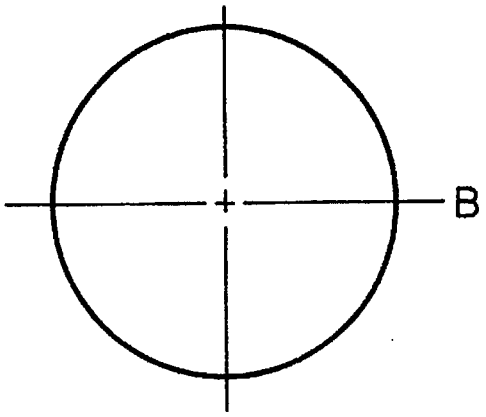
FIG. 6*b* is a terminal cross-section of the duct or diffuser of FIG. 6.
Figure 7:
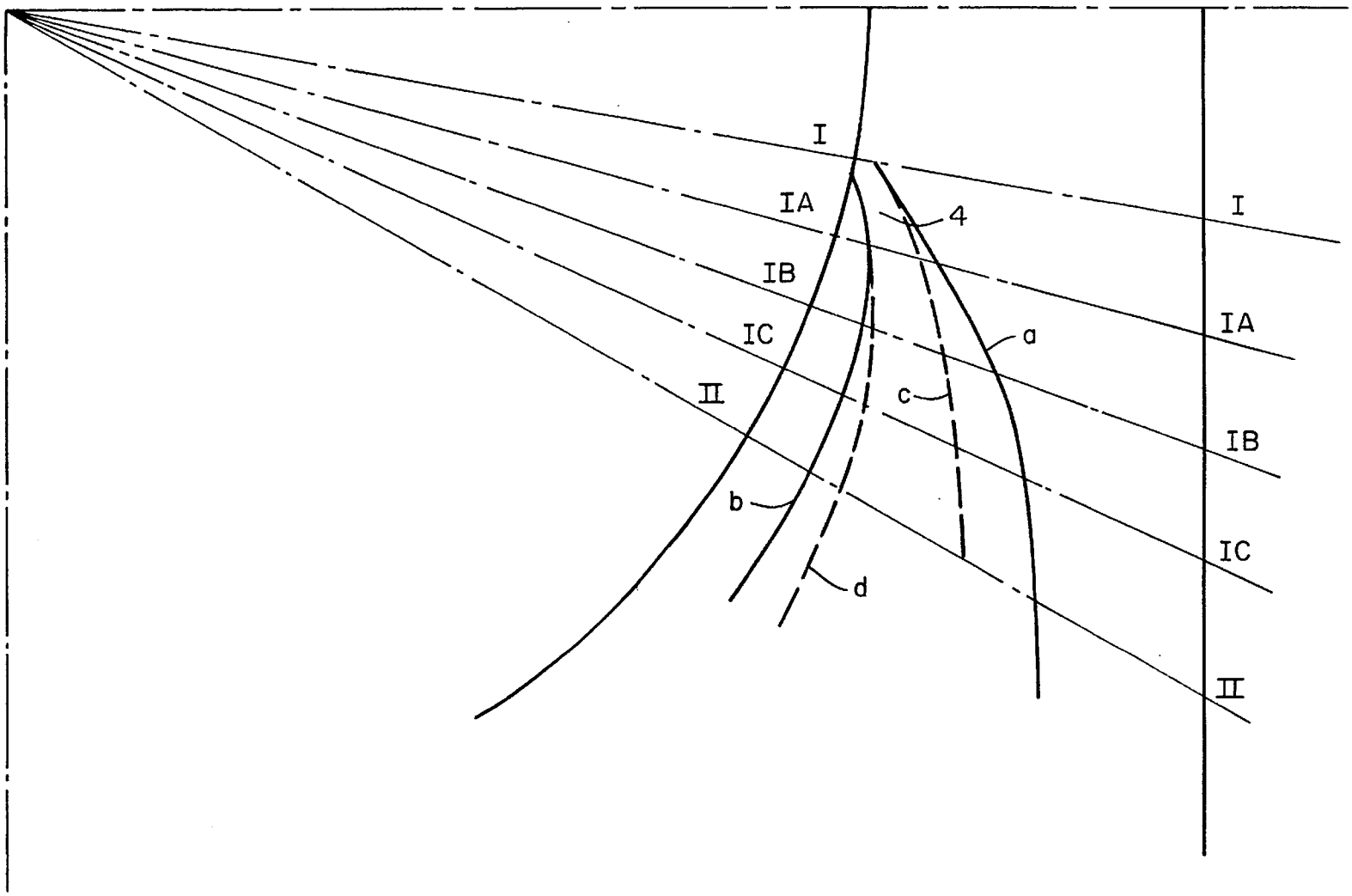
FIG. 7 a section illustrating the development of the spiral tongue at the transition to the outlet duct.

FIG. 6 is a view along C in FIG. 5 of the outlet duct 3, whereby the view of A illustrates the initial cross-section of the outlet duct which is equal to the terminal cross-section of the spiral in accordance with the present invention a view of B is the terminal cross-section of the outlet duct which is a conventional circular cross-section for the present invention and the conventional spiral (dotted line in FIG. 5). FIG. 7 illustrates the zone I–II in FIG. 5 in detail along with spiral tongue 4.

Figure 8:
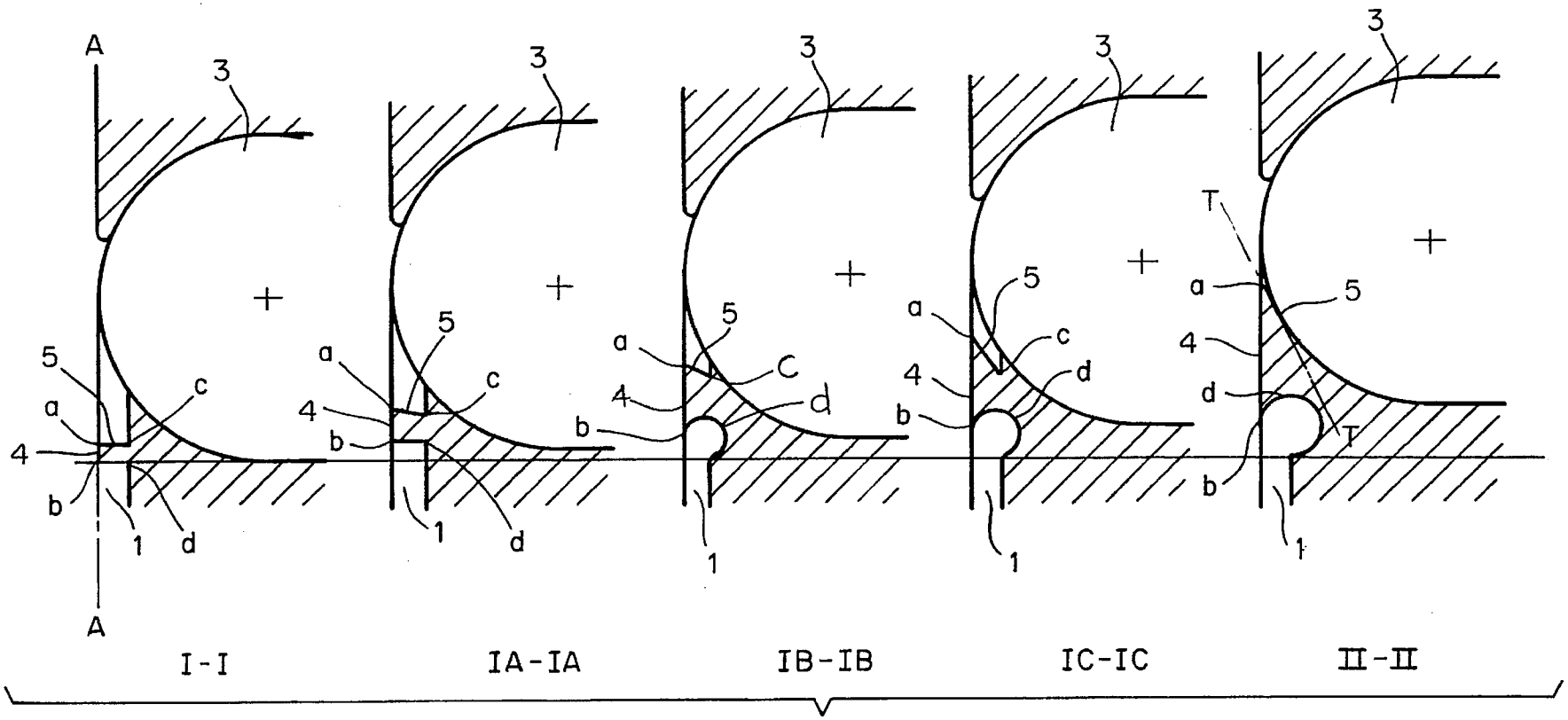
FIG. 8 a longitudinal section illustrating the development of the spiral cross-section between I—I and II—II.

FIG. 8 illustrates in detail the development of the spiral tongue 4 in radial section, with its upper edge 5 sloping from the axially parallel direction in direction T of the radial tangent to point of debouchment into the outlet duct 3.

We claim:

1. A spiral housing with a spiral cross-section for a turbomachine, comprising: a disk diffuser with an upstream annular disk space is asymmetrical to said spiral cross-section, said spiral cross-section having a base circle of substantially constant diameter; said spiral cross-section having a tongue region and a region adjacent said tongue region with circular spiral cross-sections extending to where an outside diameter of said spiral cross-section equals a specific diameter and said circular spiral cross-sections continue thereafter to increase in cross-section only axially.

2. A spiral housing as defined in claim 1, wherein after said outside diameter has attained a constant value, said spiral cross-section is axially bordered on each side by a semicircular area with a radius, $R_G$, given by $$R_G = \frac{(r_G - r_Z)}{2}$$

and an inwardly and outwardly flush terminating rectangular area 2 $R_G \cdot L$ between the semicircular areas, where $r_G$=limiting radius of said housing $r_Z$=base circle radius L=axial length of the spiral cross-section.

3. A spiral housing as defined in claim 1, wherein said tongue region has a bottom and a top extending initially coaxially, said top sloping continuously into a tangent to a point of debouchment and into an outlet of said spiral cross-section.

4. A spiral housing as defined in claim 1, including a continuous transition to a circular cross-section after a point of transition between said spiral cross-section and an outlet leading from said spiral cross-section.

5. A spiral housing as defined in claim 1 wherein said annular disk space is radial.

* * * * *